US010001148B2

(12) United States Patent
Renner

(10) Patent No.: US 10,001,148 B2
(45) Date of Patent: Jun. 19, 2018

(54) SYSTEMS AND METHODS FOR DETECTING A TYPE OF HYDRAULIC DEVICE

(71) Applicant: Illinois Tool Works Inc., Glenview, IL (US)

(72) Inventor: Ross Neal Renner, Black Creek, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days. days.

(21) Appl. No.: 15/800,416

(22) Filed: Nov. 1, 2017

(65) Prior Publication Data

US 2018/0094649 A1 Apr. 5, 2018

Related U.S. Application Data

(62) Division of application No. 13/867,465, filed on Apr. 22, 2013, now Pat. No. 9,835,181.

(51) Int. Cl.

| | |
|---|---|
| ***F15B 13/00*** | (2006.01) |
| ***B66C 13/18*** | (2006.01) |
| ***F15B 21/08*** | (2006.01) |
| ***B66C 23/42*** | (2006.01) |

(52) U.S. Cl.

CPC ..... *F15B 13/00* (2013.01); *B66C 13/18* (2013.01); *B66C 23/42* (2013.01); *F15B 21/08* (2013.01); *F15B 2211/6303* (2013.01)

(58) Field of Classification Search

CPC ..... B66C 23/36–23/53; B66C 23/54–23/56; B66C 13/18; B66C 23/42; F15B 2211/63–2211/6346; F15B 2211/65–2211/654; F15B 2211/665–2211/6658; F15B 2211/70–2211/785; F15B 2211/80–2211/895; F15B 13/00; F15B 21/08; F15B 2211/6303; G01L 27/00–27/005

USPC ..... 701/36

See application file for complete search history.

(56) References Cited

U.S. PATENT DOCUMENTS 3,922,954 A * 12/1975 Gustafsson ..... B66C 23/54 137/115.16
4,230,196 A * 10/1980 Snead ..... E02F 3/3411 177/141
4,268,785 A * 5/1981 Svendsen ..... G05B 5/01 318/608

(Continued)

FOREIGN PATENT DOCUMENTS

EP 1602907 12/2005
JP S57146082 9/1982

(Continued)

*Primary Examiner* — Courtney D Heinle

(74) *Attorney, Agent, or Firm* — McAndrews, Held & Malloy, Ltd.

(57) ABSTRACT

A system for detecting a type of hydraulic device. The system includes a hydraulic device. The system also includes a power supply having an engine and a controller. The controller is configured to detect a voltage of a signal from the hydraulic device, to categorize the signal as a type of signal of multiple types of signals based on the voltage, and to control a hydraulic output based on the voltage and the type of the signal.

15 Claims, 4 Drawing Sheets

(56) References Cited

U.S. PATENT DOCUMENTS 5,297,019 A * 3/1994 Zuehlke ..... B66C 13/18 700/1
5,472,056 A * 12/1995 Orbach ..... A01B 63/1117 172/2
5,968,104 A * 10/1999 Egawa ..... E02F 3/435 37/414
6,115,654 A * 9/2000 Eid ..... G01D 21/02 244/1 R
6,121,691 A * 9/2000 Renner ..... B23K 9/1006 219/133
6,153,855 A * 11/2000 Renner ..... B23K 9/1006 219/130.21
6,202,410 B1 * 3/2001 Nakashima ..... B62D 5/065 60/433
6,216,456 B1 * 4/2001 Mitchell ..... E02F 9/2217 417/212
6,450,081 B1 * 9/2002 Sorbel ..... E02F 9/2225 91/443
6,604,423 B1 * 8/2003 Irokawa ..... G01L 15/00 73/714
6,812,585 B2 * 11/2004 Renner ..... F02D 41/042 123/406.14
7,908,911 B2 * 3/2011 Renner ..... G01F 1/8468 73/114.52
8,342,150 B2 * 1/2013 Renner ..... B66C 23/42 123/350
2006/0288863 A1 * 12/2006 Ueda ..... F15B 19/005 91/459
2007/0035316 A1 * 2/2007 Rupp ..... G08C 19/02 324/713
2009/0194067 A1 * 8/2009 Peotter ..... B66C 23/42 123/350
2009/0243831 A1 * 10/2009 Miura ..... E02F 3/963 340/450
2010/0071358 A1 * 3/2010 Ueda ..... E02F 9/2242 60/420
2010/0199655 A1 * 8/2010 Renner ..... B60P 3/14 60/431
2010/0308559 A1 * 12/2010 Tarasinski ..... A01B 59/00 280/422
2010/0316505 A1 * 12/2010 Renner ..... B66C 23/42 417/53
2010/0318283 A1 * 12/2010 Renner ..... B60P 3/14 701/112
2011/0052415 A1 * 3/2011 Renner ..... B66C 23/42 417/11
2011/0167919 A1 * 7/2011 Plochinger ..... G01L 19/0007 73/753
2011/0173963 A1 * 7/2011 Renner ..... B60P 3/14 60/327
2012/0029775 A1 * 2/2012 Peters ..... B23K 9/1006 701/50
2013/0274925 A1 * 10/2013 Oates, Jr. ..... E02F 3/96 700/275
2014/0102741 A1 * 4/2014 Sekino ..... B25B 21/02 173/181
2014/0285225 A1 * 9/2014 Cho ..... G01D 21/00 324/705
2014/0311138 A1 * 10/2014 Renner ..... F15B 13/00 60/327
2015/0120249 A1 * 4/2015 Hernke ..... A61B 5/0205 702/189
2015/0345113 A1 * 12/2015 Lim ..... E02F 9/2253 701/50

FOREIGN PATENT DOCUMENTS

JP H09138169 5/1997
JP 2007232579 9/2007

* cited by examiner

SYSTEMS AND METHODS FOR DETECTING A TYPE OF HYDRAULIC DEVICE

CROSS-REFERENCE TO RELATED APPLICATIONS/INCORPORATION BY REFERENCE

This application is a divisional of U.S. patent application Ser. No. 13/867,465 filed Apr. 22, 2013, which is hereby incorporated herein by reference.

BACKGROUND

The invention relates generally to hydraulic systems, and, more particularly, to systems and methods for detecting a type of hydraulic device in a hydraulic system.

Existing work vehicles often integrate auxiliary resources, such as electrical power, compressor air service, and/or hydraulic service, with a power supply. For example, various hydraulic devices, such as hydraulic cranes, may be driven by the power supply. Specifically, the hydraulic devices may receive hydraulic power from the power supply.

Many different types of hydraulic devices may be connected to the power supply to receive hydraulic power. When connected to a power supply, a hydraulic device may provide a signal to the power supply to indicate that the hydraulic device has a load applied to it. Unfortunately, the signal provided from one type of hydraulic device may be in a different format than the signal provided from another type of hydraulic device. For example, one signal may be a positive proportional signal, while another signal may be a negative proportional signal. Accordingly, it may be difficult for the power supply to properly control hydraulic output to the hydraulic device.

BRIEF DESCRIPTION

In one embodiment, a system includes a hydraulic device. The system also includes a power supply having an engine and a controller. The controller is configured to detect a voltage of a signal from the hydraulic device, to categorize the signal as a type of signal of multiple types of signals based on the voltage, and to control a hydraulic output based on the voltage and the type of the signal.

In another embodiment, a method is for modifying a signal from a hydraulic device electrically connected to a power supply. The method includes detecting a voltage of the signal from the hydraulic device and comparing the voltage to a first threshold voltage. The method also includes applying a first adjustment to the voltage if the voltage is greater than the first threshold voltage and less than a second threshold voltage. The method includes applying a second adjustment to the voltage if the voltage is greater than or equal to the second threshold voltage.

In a further embodiment, a power supply includes one or more tangible, machine-readable media having instructions encoded thereon for execution by a processor. The instructions include instructions to determine a voltage of a signal from a hydraulic device, instructions to categorize the signal as a type of signal of multiple types of signals based on the voltage, and instructions to control an output based on the voltage and the type of the signal.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
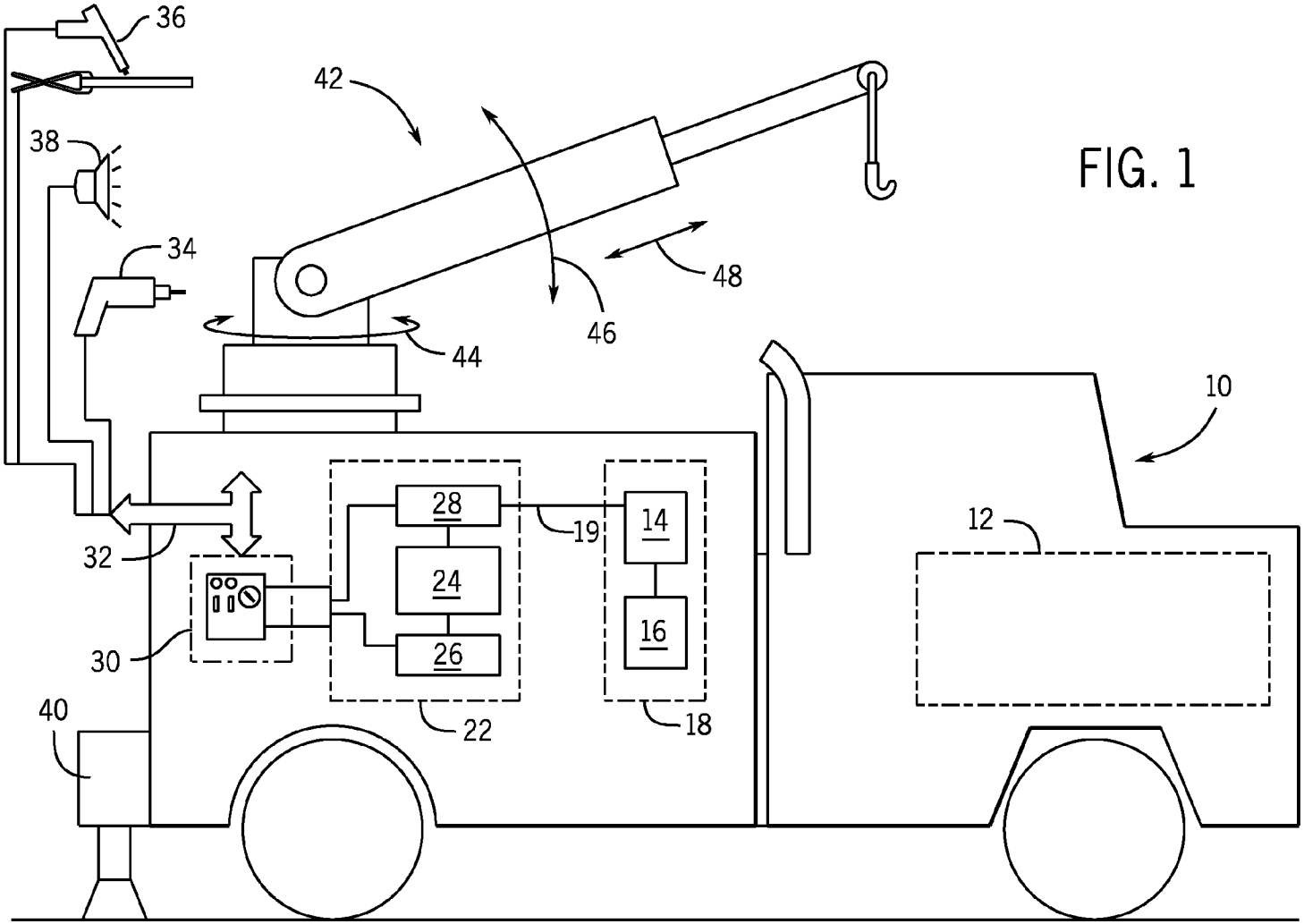
FIG. 1 is a diagram of an embodiment of a work vehicle having service pack modules for operating a hydraulic device, in accordance with aspects of the present disclosure.

Turning now to the drawings, FIG. 1 is a diagram of an embodiment of a work vehicle 10 including a main vehicle engine 12, and first and second service pack modules 18 and 22 for operating one or more hydraulic devices. As discussed in further detail below, the first and second service pack modules 18 and 22 (e.g., power supplies) may provide various resources, such as electrical power, compressed air, and hydraulic power, with or without assistance from the main vehicle engine 12. Thus, in some embodiments, the operator can shut off the main vehicle engine to reduce noise, conserve fuel, and increase the life of the main vehicle engine 12, while the service pack modules 18 and 22 are self-powered or power one another. However, in some embodiments, the service pack modules 18 and 22 may utilize and/or provide some resources of the vehicle 10, e.g., use fuel from the vehicle, use hydraulic power from the vehicle, provide hydraulic power to the vehicle, and so forth. The illustrated work vehicle 10 is a work truck, yet other embodiments of the vehicle may include other types and configurations of vehicles.

The main vehicle engine 12 may include a spark ignition engine (e.g., gasoline fueled internal combustion engine) or a compression ignition engine (e.g., a diesel fueled engine), for example, an engine with 6, 8, 10, or 12 cylinders with over 200 horsepower. The vehicle engine 12 includes a number of support systems. For example, the vehicle engine 12 consumes fuel from a fuel reservoir, typically one or more liquid fuel tanks. Further, the vehicle engine 12 may include or be coupled to an engine cooling system, which may include a radiator, circulation pump, thermostat controlled valve, and a fan. The vehicle engine 12 also includes an electrical system, which may include an alternator or generator along with one or more system batteries, cable assemblies routing power to a fuse box or other distribution system, and so forth. The vehicle engine 12 also includes an oil lubrication system. Further, the vehicle engine 12 also couples to an exhaust system, which may include catalytic converters, mufflers, and associated conduits. Finally, the vehicle engine 12 may feature an air intake system, which may include filters, flow measurement devices, and associated conduits.

The service pack modules 18 and 22 may have a variety of resources, such as electrical power, compressed air, hydraulic power, and so forth. These service pack modules 18 and 22 also may operate alone or in combination with one another, e.g., dependent on one another. In the illustrated embodiment, the first service pack module 18 includes a service pack engine 14 and a variable displacement pump 16. In particular, the variable displacement pump 16 may include a hydraulic pump, a water pump, a waste pump, a chemical pump, or any other fluid pump. The service pack engine 14 may include a spark ignition engine (e.g., gasoline fueled internal combustion engine) or a compression ignition engine (e.g., a diesel fueled engine), for example, an engine with 1-4 cylinders with approximately 10-80 horsepower. In some embodiments, the service pack engine 14 may have a relatively small engine with approximately 10, 20, 30, 40, or 50 horsepower. Moreover, the service pack engine 14 may be undersized to improve fuel consumption, while the variable displacement pump 16 can satisfy the needs of the operator by providing full pressure at less than full flow, or by providing full flow at less than full pressure (e.g., "power matching"). The variable displacement pump 16 may be configured to provide hydraulic power (e.g., pressurized hydraulic fluid) to one or more devices in the vehicle or elsewhere.

As illustrated in the embodiment of FIG. 1, the first and second service pack modules 18 and 22 are separate from one another and from the vehicle engine 12. In other words, the first and second service pack modules 18 and 22 are stand-alone units relative to the vehicle engine 12, such that they do not rely on power from the vehicle engine 12. In some embodiments, the first and second service pack modules 18 and 22 may be combined as a single standalone unit, while still being separate from the vehicle engine 12. However, in the illustrated embodiment, the second service pack module 22 is driven by hydraulic fluid from the first service pack module 18, thereby making the second service pack module 22 dependent on the first service pack module 18 or another source of fluid (e.g., hydraulic fluid).

A clutch 24 contained in the second service pack module 22 may selectively couple an air compressor 26 and a generator 28. Moreover, the generator 28 may be driven directly, or may be belt, gear, or chain driven, by the service pack engine 14. Specifically, as illustrated in FIG. 1, the service pack engine 14 drives the generator 28 via a shaft 19. The generator 28 may include a three-phase brushless type, capable of producing power for a wide range of applications. However, other generators may be employed, including single phase generators and generators capable of producing multiple power outputs. The air compressor 26 may also be of any suitable type, although a rotary screw air compressor may be used due to its output-to-size ratio. Other suitable air compressors might include reciprocating compressors, typically based upon one or more reciprocating pistons.

The first and/or second service pack modules 18 and 22 include conduits, wiring, tubing, and so forth for conveying the services/resources (e.g., electrical power, compressed air, and fluid/hydraulic power) generated by these modules to an access panel 30. The access panel 30 may be located on any portion of the vehicle 10, or on multiple locations in the vehicle 10, and may be covered by doors or other protective structures. In one embodiment, all of the services may be routed to a single/common access panel 30. The access panel 30 may include various control inputs, indicators, displays, electrical outputs, pneumatic outputs, and so forth. In an embodiment, a user input may include a knob or button configured for a mode of operation, an output level or type, etc. In the illustrated embodiment, the first and second service pack modules 18 and 22 supply electrical power, compressed air, and fluid power (e.g., hydraulic power) to a range of applications designated generally by arrows 32.

As depicted, an air tool 34, a torch 36, and a light 38 are applications connected to the access panel 30 and, thus, the resources/services provided by the service pack modules 18 and 22. The various tools may connect with the access panel 30 via electrical cables, gas (e.g., air) conduits, fluid (e.g., hydraulic) lines, and so forth. The air tool 34 may include a pneumatically driven wrench, drill, spray gun, or other types of air-based tools, which receive compressed air from the access panel 30 and compressor 26 via a supply conduit (e.g., a flexible rubber hose). The torch 36 may utilize electrical power and compressed gas (e.g., air or inert shielding gas) depending on the particular type and configuration of the torch 36. For example, the torch 36 may include a welding torch, a cutting torch, a ground cable, and so forth. More specifically, the welding torch 36 may include a TIG (tungsten inert gas) torch or a MIG (metal inert gas) gun. The cutting torch 36 may include a plasma cutting torch and/or an induction heating circuit. Moreover, a welding wire feeder may receive electrical power from the access panel 30. Furthermore, a hydraulically powered vehicle stabilizer 40 may be powered by the fluid system, e.g., variable displacement pump 16, to stabilize the work vehicle 10 at a work site.

As illustrated, a hydraulically powered crane 42 (e.g., or another hydraulically powered device) is also coupled to and powered by the service pack modules 18 and/or 22. As may be appreciated, the crane 42 may provide one or more feedback signals to the service pack modules 18 and/or 22. The feedback signals may be in one of a variety of formats based on the type of crane 42. For example, the format may include a normal (e.g., standard) signal, a step signal, a positive proportional signal, an offset step signal, a negative proportional signal, and so forth. Accordingly, the service pack modules 18 and/or 22 may be configured to detect the format, to determine an output based on the signal and the format of the signal, and to control the crane 42 using the determined output.

As noted above, the disclosed service pack modules 18 and 22 may be designed to interface with any desired type of vehicle. Such vehicles may include cranes, manlifts, and so forth, which can be powered by the service pack modules 18 and/or 22. In the embodiment of FIG. 1, the crane 42 may be mounted within a bed of the vehicle 10, on a work platform of the vehicle 10, or on an upper support structure of the vehicle 10 as shown in FIG. 1. Moreover, such cranes may be mechanical, electrical or hydraulically powered. In the illustrated embodiment, the crane 42 can be powered by the service pack modules 18 and/or 22 without relying on the vehicle engine 12. That is, once the vehicle is positioned at the work site, the vehicle engine 12 may be stopped and the service pack engine 14 may be started for crane 42 operation and use of auxiliary services. In the embodiment illustrated in FIG. 1, the crane 42 is mounted on a rotating support structure, and hydraulically powered such that it may be rotated, raised and lowered, and extended (as indicated by arrows 44, 46 and 48, respectively) by pressurized hydraulic fluid provided by the service pack output 32.

The vehicle 10 and/or the service pack modules 18 and 22 may include a variety of protective circuits for the electrical power, e.g., fuses, circuit breakers, and so forth, as well as valving for the fluid (e.g., hydraulic) and air service. For the supply of electrical power, certain types of power may be conditioned (e.g., smoothed, filtered, etc.), and 12 volt power output may be provided by rectification, filtering and regulating of AC output. Valving for fluid (e.g., hydraulic) power output may include by way of example, pressure relief valves, check valves, shut-off valves, as well as directional control valving. Moreover, the variable displacement pump 16 may draw fluid from and return fluid to a fluid reservoir, which may include an appropriate vent for the exchange of air during use with the interior volume of the reservoir, as well as a strainer or filter for the fluid. Similarly, the air compressor 26 may draw air from the environment through an air filter.

The first and second service pack modules 18 and 22 may be physically positioned at any suitable location in the vehicle 10. In a presently contemplated embodiment, for example, the service pack modules 18 and 22 may be mounted on, beneath or beside the vehicle bed or work platform rear of the vehicle cab. In many such vehicles, for example, the vehicle chassis may provide convenient mechanical support for the engine and certain of the other components of the service pack modules 18 and 22. For example, steel tubing, rails or other support structures extending between front and rear axles of the vehicle 10 may serve as a support for the service pack modules 18 and 22 and, specifically, the components self-contained in those modules. Depending upon the system components selected and the placement of the service pack modules 18 and 22, reservoirs may be provided for storing fluid (e.g., hydraulic fluid) and pressurized air as noted above. The fluid reservoir may be placed at various locations or even be integrated into the service pack modules 18 and/or 22. Likewise, depending upon the air compressor 26 selected, no reservoir may be used for compressed air. Specifically, if the air compressor 26 includes a non-reciprocating or rotary type compressor, then the system may be tankless with regard to the compressed air.

In use, the service pack modules 18 and 22 provide various resources/services (e.g., electrical power, compressed air, fluid/hydraulic power, etc.) for the on-site applications completely independent of the vehicle engine 12. For example, the service pack engine 14 generally may not be powered during transit of the vehicle 10 from one service location to another, or from a service garage or facility to a service site. Once located at the service site, the vehicle 10 may be parked at a convenient location, and the main vehicle engine 12 may be shut down. The service pack engine 14 may then be powered to provide auxiliary service from one or more of the service systems described above. Where desired, clutches, gears, or other mechanical engagement devices may be provided for engagement and disengagement of one or more of the generator 28, the variable displacement pump 16, and the air compressor 26, depending upon which of these service are desired. Moreover, as in conventional vehicles, where stabilization of the vehicle or any of the systems is required, the vehicle 10 may include outriggers, stabilizers, and so forth which may be deployed after parking the vehicle 10 and prior to operation of the service pack modules 18 and 22. The disclosed embodiments thus allow for a service to be provided in several different manners and by several different systems without the need to operate the main vehicle engine 12 at a service site.

Figure 2:
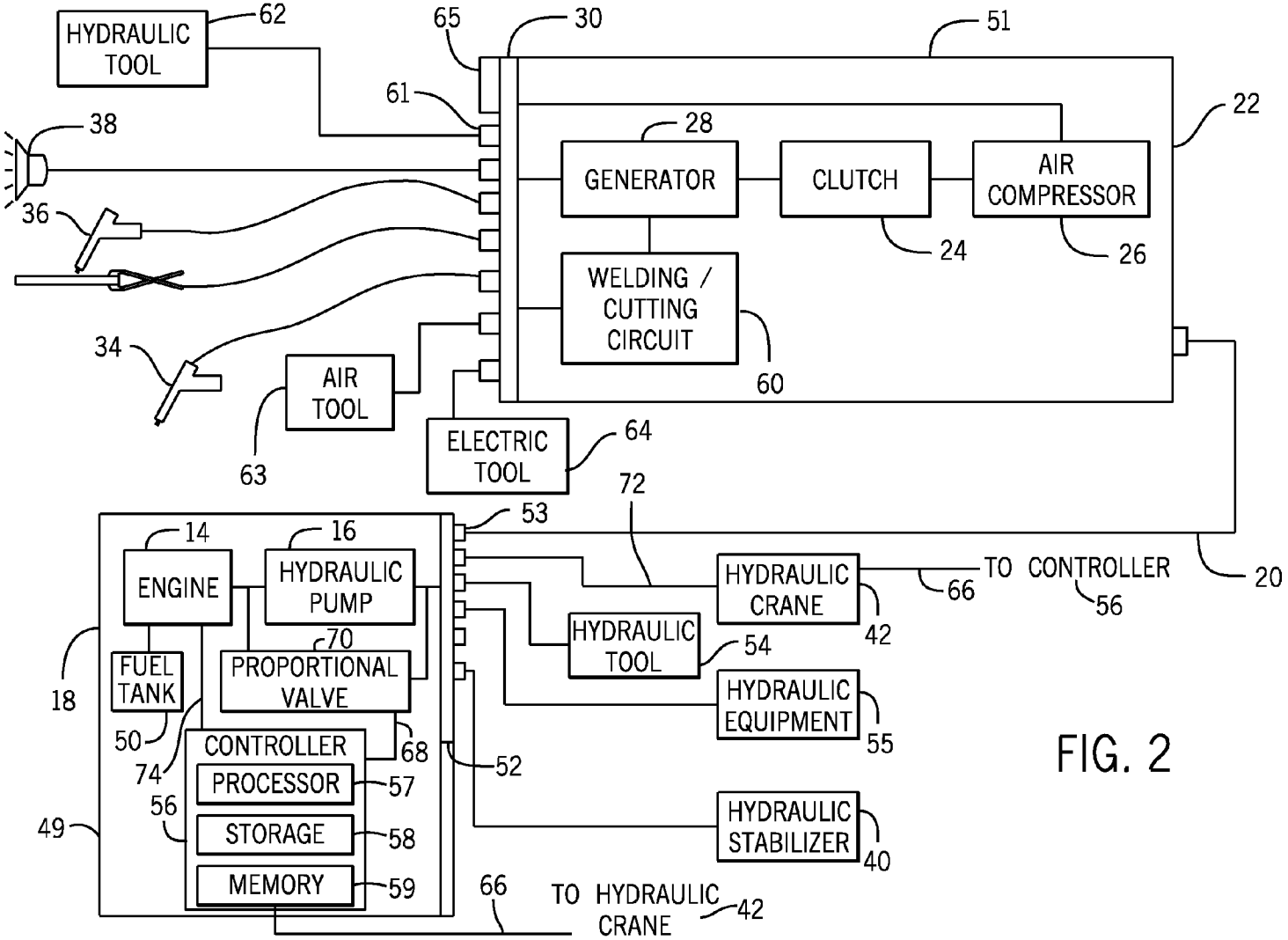
FIG. 2 is block diagram of an embodiment of the service pack modules of FIG. 1, in accordance with aspects of the present disclosure.

Several different arrangements are possible for the components of the first service pack module 18 and the second service pack module 22. FIG. 2 is a block diagram of an embodiment of the first and second service pack modules 18 and 22, wherein the first service pack module 18 includes the service pack engine 14, the variable displacement pump 16, and a fuel tank 50, and wherein the second service pack module 22 includes the clutch 24, the air compressor 26, and the generator 28. As discussed below, the components of each service pack module 18 and 22 are self-contained in respective enclosures 49 and 51, such that the modules 18 and 22 are independent and distinct from one another. In other words, the enclosure 49 of the first service pack module 18 self contains the engine 14, the pump 16, and the fuel tank 50 independent of both the second service pack module 22 and various components of the vehicle 10. Similarly, the enclosure 51 of the second service pack module 22 self contains the clutch 24, the air compressor 26, and the generator 28 independent of both the first service pack module 18 and various components of the vehicle 10. Again, in alternate embodiments, a single unit may include the components of both service pack modules 18 and 22.

The service pack modules 18 and 22 may be used independently or in combination with one another. For example, the first service pack module 18 may be used to provide fluid (e.g., hydraulic) power for any type of fluid driven (e.g., hydraulically driven) system, which may or may not include the second service pack module 22. In certain embodiments, the first service pack module 18 may be described as dependent only on a source of fuel, such as gasoline or diesel fuel, to operate the engine 14 and provide the hydraulic power. By further example, the second service pack module 22 may be hydraulically driven by any suitable source of hydraulic power, which may or may not include the hydraulic pump 16 of the first service pack module 18. Thus, in certain embodiments, the second service pack module 22 may be described as hydraulically dependent on some source of hydraulic power, or more specifically, only hydraulic power dependence. However, some embodiments may combine the components of these two service pack modules 18 and 22 into a single unit.

As illustrated in FIG. 2, the first service pack module 18 includes a first service access panel 52, which includes fluid couplings 53 to output fluid (e.g., hydraulic fluid) from the variable displacement pump 16 to various external devices. In the illustrated embodiment, the fluid couplings 53 couple to the second service pack module 22, the hydraulic crane 42, a hydraulic tool 54, the hydraulic stabilizer 40, and other hydraulic equipment 55. For example, the second service pack module 22 is connected to the first service pack module 18 via a fluid tubing 20 (e.g., hydraulic tubing) connected to one of the couplings 53. Furthermore, the first service pack module 18 includes a controller 56 to control operation of the first service pack module 18 (e.g., send and/or receive control signals for operating the first service pack module 18). For example, the controller 56 may be configured to detect a voltage of a signal from a hydraulic device (e.g., before the engine 14 is turned on, such as a one time event that occurs within a few seconds of the controller 56 receiving power and while power is on at the hydraulic device), to categorize the signal as a type of signal of multiple types of signals based on the voltage, and to control an output based on the voltage and the type of the signal. The controller 56 includes one or more processors 57, storage devices 58, and memory devices 59.

The one or more processors 57 control the operations of the first service pack module 18, and may be configured to receive and process multiple inputs regarding the performance and demands of the first service pack module 18. Furthermore, the processor(s) 57 may include one or more microprocessors, such as one or more "general-purpose" microprocessors, one or more special-purpose microprocessors and/or ASICS, or some combination thereof. For example, the processor(s) 57 may include one or more reduced instruction set (RISC) processors.

The storage device(s) 58 (e.g., nonvolatile storage) may include ROM, flash memory, a hard drive, or any other suitable optical, magnetic, or solid-state storage medium, or a combination thereof. The storage device(s) 58 may store data, instructions (e.g., software or firmware to perform various processes), and any other suitable data.

The memory device(s) 59 may include a volatile memory, such as random access memory (RAM), and/or a nonvolatile memory, such as read-only memory (ROM). The memory device(s) 59 may store a variety of information and may be used for various purposes. For example, the memory device(s) 59 may store processor-executable instructions (e.g., firmware or software) for the processor(s) 57 to execute. In addition, a variety of control regimes for various processes, along with associated settings and parameters may be stored in the storage device(s) 58 and/or memory device(s) 59, along with code configured to provide a specific output during operation. As may be appreciated, the storage device(s) 58 and/or memory device(s) 59 may be considered tangible, machine-readable media having instructions thereon for execution by the processor(s) 57.

For example, the storage device(s) 58 and/or memory device(s) 59 may include instructions to determine a voltage of a signal from a hydraulic device, to compare the voltage to a first threshold voltage, to categorize the signal as a type of signal of multiple signals based on the voltage, to apply a first adjustment to the voltage (e.g., or to some other parameter) if the voltage is greater than the first threshold voltage and less than a second threshold voltage (e.g., apply an offset to the voltage, or to some other parameter), to apply a second adjustment to the voltage (e.g., or to some other parameter) if the voltage is greater than or equal to the second threshold voltage (e.g., changing a negative proportional signal to a positive proportional signal, or change some other parameter), to apply no adjustment to the voltage if the voltage is less than or equal to the first threshold voltage, and to control an output based on the voltage and the type of signal.

As further illustrated in FIG. 2, the second service pack module 22 includes the clutch 24 selectively coupled between the air compressor 26 and the generator 28, which may be connected to a welding/cutting circuit 60. The circuit 60 may include one or more circuits configured to provide power, functions, and control for welding, cutting, wire feeding, gas supply, and so forth. The generator 28 may provide electrical power to the welding circuit 60 to operate various welding devices, such as those discussed above. The second service pack module 22 may, in certain embodiments, include a service pack access panel (e.g., 30), which includes couplings 61 (e.g., electrical, air, and optionally hydraulic connectors) for various external devices. For example, the service pack module 22 may or may not provide fluid couplings 61 (e.g., hydraulic couplings) as a pass through from the fluid received into the system. Connections to the access panel 30 may provide service to several tools, including a hydraulic tool 62, an air tool 63, an electric tool 64, the air tool (e.g., wrench) 34, the torch 36, and the light 38. In addition, the various external devices include electrical cables, air hoses, fluid tubing, and so forth, as illustrated by the lines extending between the devices and their respective couplings 61 on the access panel 30. The access panel 30 also may include one or more controls 65 for the various services/resources, e.g., electrical power, compressed air, hydraulics, etc. As discussed below, these controls 65 may include input controls (e.g., switches, selectors, keypads, etc.) and output displays, gauges, and the like.

As appreciated, the generator 28 and/or circuit 60 may be configured to provide AC power, DC power, or both, for various applications. Moreover, the circuit 60 may function to provide constant current or constant voltage regulated power suitable for a welding or cutting application. Thus, the torch 36 may be a welding torch 36, such as a MIG welding torch, a TIG welding torch, and so forth. The torch 36 also may be a cutting torch, such as a plasma cutting torch. The generator 28 and/or circuit 60 also may provide a variety of output voltages and currents suitable for different applications. For example, a 12 volt DC output of the module 22 may also serve to maintain the vehicle battery charge, and to power any ancillary loads that the operator may need during work (e.g., cab lights, hydraulic system controls, etc.).

As illustrated, a conductor 66 is coupled between the hydraulic crane 42 and the controller 56. The conductor 66 may be configured to provide a signal (e.g., a voltage) from the hydraulic crane 42 to the controller 56. In certain embodiments, the hydraulic crane 42 may provide the signal to the controller 56 wirelessly, or by some other medium. The controller 56 processes the signal and controls an output 68 provided to a proportional valve 70. The proportional valve 70 is coupled to the input and the output of the hydraulic pump 16 and configured to control the output of the hydraulic pump 16 (e.g., to control the quantity of hydraulic fluid flowing to hydraulic devices, such as fluid flow through conduit 72 coupled to the hydraulic crane 42). Thus, while the controller 56 directly controls the proportional valve 70, the controller 56 indirectly controls the flow of hydraulic fluid to one or more hydraulic devices. The controller 56 is also coupled to the engine 14 and configured to provide a control signal 74 to the engine 14 (e.g., to control a speed of the engine 14).

Figure 3:
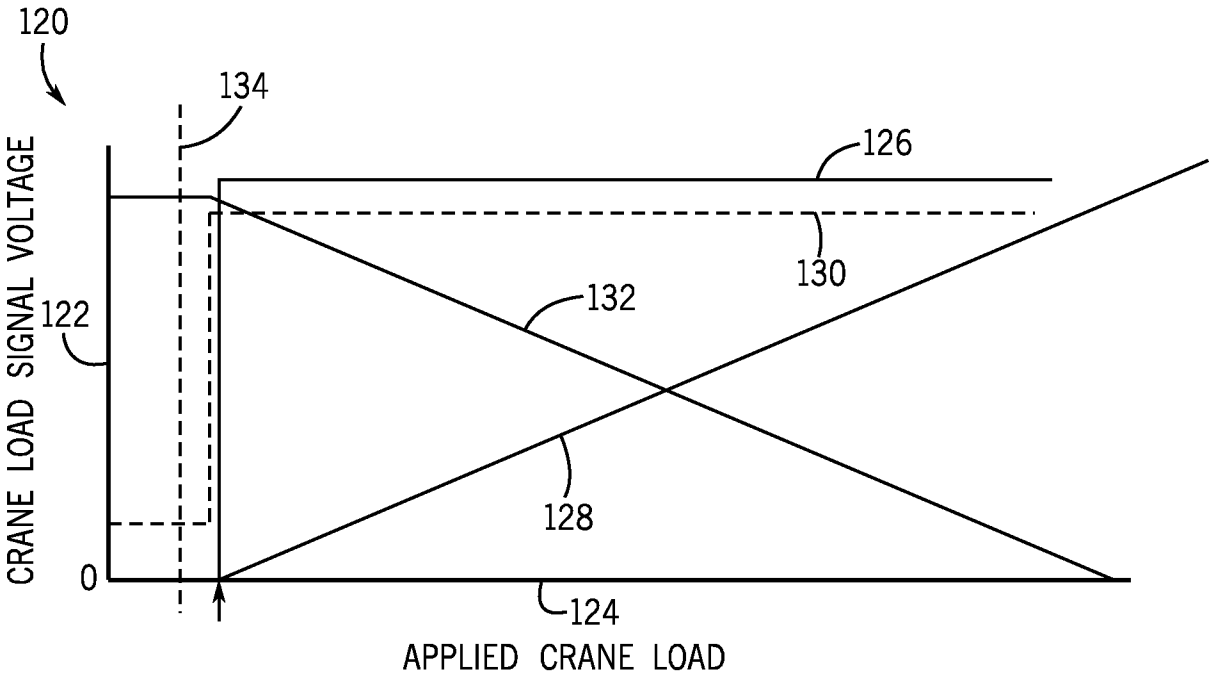
FIG. 3 is a graph illustrating signals that may be received from a hydraulic device, in accordance with aspects of the present disclosure.

FIG. 3 is a graph 120 illustrating signals that may be received from a hydraulic device. As may be appreciated, the controller 56 may receive the signals from the hydraulic device (e.g., the hydraulic crane 42). One such signal, a hydraulic signal, may indicate that a load is applied to the hydraulic device. This signal may be sensed when a system, such after the service pack module 18 is turned on, after the hydraulic device is turned on, and before the engine 14 of the service pack module 18 is turned on. By sensing the hydraulic signal being provided from the hydraulic device when the hydraulic device is not functioning, a type of hydraulic device may be determined by comparing the voltage of the hydraulic signal to possible voltages of hydraulic signal values. FIG. 3 illustrates four different types of hydraulic signals that may be received from different hydraulic cranes 42. The hydraulic signals are illustrated with the y-axis representing a crane load signal voltage 122 (e.g., hydraulic signal received from the hydraulic crane 42) and the x-axis representing an applied crane load 124.

A step signal 126 with a low crane load has a crane load signal voltage of approximately 0.0 Vdc and steps to a predetermined voltage (e.g., approximately 8.0 to 15.0 volts) when a crane load is increased beyond a threshold value. Moreover, a positive proportional signal 128 with a low crane load has a crane load signal voltage of approximately 0.0 Vdc and proportionally increases from 0.0 Vdc toward the predetermined voltage as a crane load increases. In certain embodiments, the step signal 126 and/or the positive proportional signal 128 may be considered normal signals (e.g., due to starting at approximately 0.0 Vdc). Furthermore, an offset step signal 130 with a low crane load has a crane load signal voltage above zero, such as approximately 0.3 to 5.0 Vdc, and steps to the predetermined voltage when a crane load is increased beyond a threshold value. A negative proportional signal 132 with a low crane load has a high crane load signal voltage, such as a voltage greater than or equal to approximately 5.0 Vdc and the crane load signal voltage proportionally decreases from the voltage toward 0.0 Vdc as a crane load increases.

In the illustrated graph 120, a time 134 indicates a time when the service pack module 18 is turned on, but before the engine 14 is turned on. The controller 56 may be configured to sense the hydraulic signal at the time 134 to determine how to control the hydraulic device attached to the service pack module 18. As may be appreciated, the controller 56 may be able to categorize the format of the signal from the hydraulic device into one of three categories: a low crane load voltage close to approximately zero volts (e.g., step signal 126, positive proportional signal 128), a low crane load voltage offset from zero volts (e.g., offset step signal 130), and a low crane load near a predetermined (e.g., maximum) voltage (e.g., negative proportional signal 132). The controller 56 may then control hydraulic output (e.g., a quantity of hydraulic fluid) provided to the hydraulic device based on which category the hydraulic device fits within.

Figure 4:
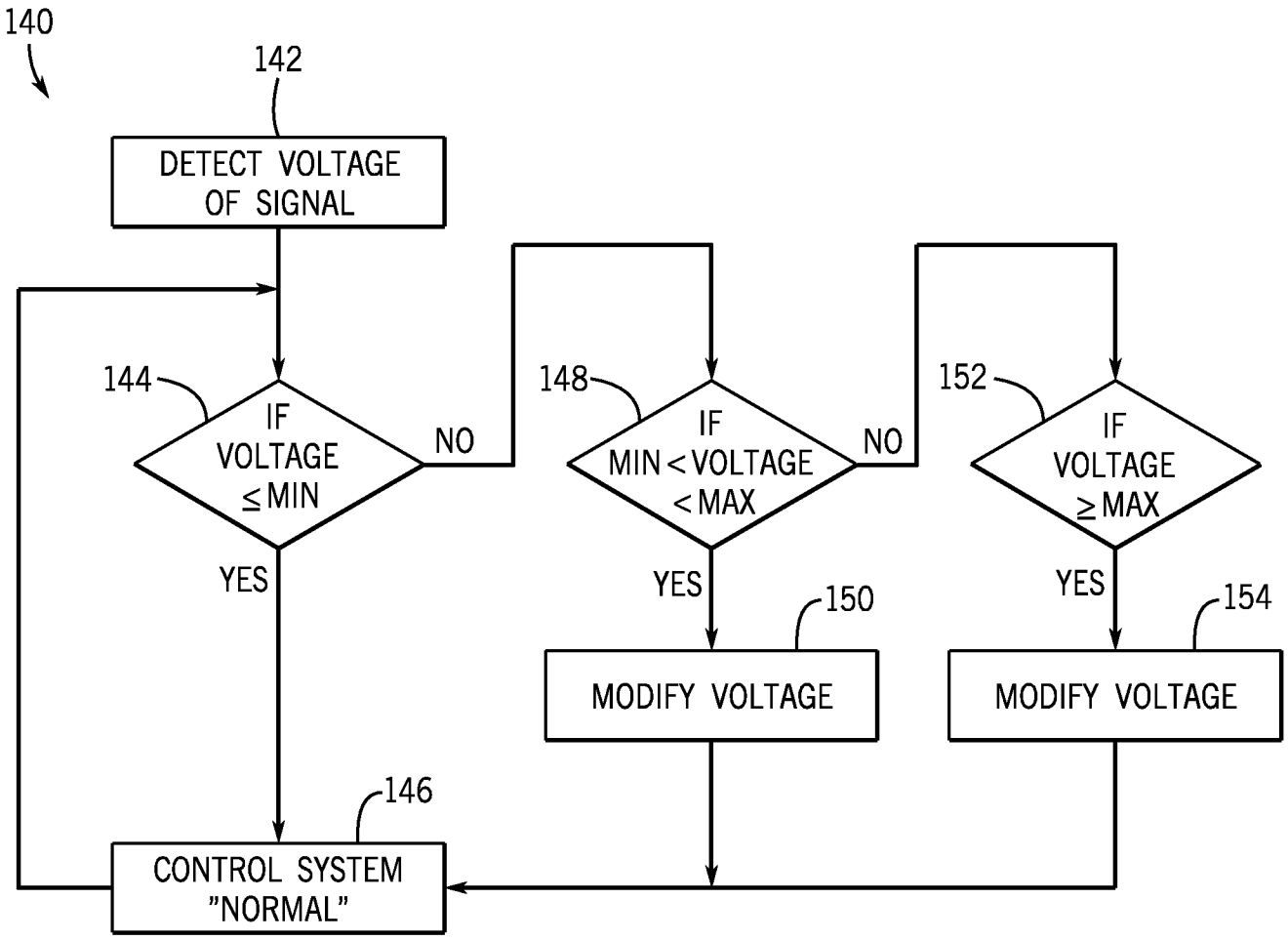
FIG. 4 is a flow chart of an embodiment of a method for modifying a signal from a hydraulic device, in accordance with aspects of the present disclosure.

FIG. 4 is a flow chart 140 of an embodiment of a method for modifying a signal from a hydraulic device. A voltage of a signal (e.g., hydraulic signal) from a hydraulic device (e.g., hydraulic crane 42) is detected by the controller 56 (block 142). As may be appreciated, while block 142 describes detecting a voltage of a signal, any suitable parameter may be sensed or detected (e.g., pressure, temperature, current, power, etc.). The controller 56 determines whether the voltage is less than or equal to a minimum voltage (block 144). In certain embodiments, the minimum voltage may be approximately 0.3 Vdc, while in other embodiments, the minimum voltage may be a percentage of a maximum voltage, such as being within a range of approximately 0 to 3% of the maximum voltage. If the voltage is less than or equal to the minimum voltage, the controller 56 categorizes the signal as corresponding to a step signal or a positive proportional signal (e.g., normal), and controls an output (e.g., hydraulic output) accordingly (block 146). However, if the voltage is greater than the minimum voltage, the controller 56 determines whether the voltage is greater than the minimum voltage and less than the maximum voltage (block 148). In certain embodiments, the maximum voltage may be approximately a maximum battery voltage, or some other voltage. For example, the maximum voltage may be approximately 8.0 to 15.0 Vdc.

If the voltage is greater than the minimum voltage and less than the maximum voltage, the controller 56 modifies the voltage (block 150). For example, the controller 56 may apply a software adjustment to the voltage (e.g., or to some other parameter), such as by applying an offset to the voltage. Furthermore, the controller 56 may categorize the signal as an offset step signal and may control the hydraulic device accordingly. If the voltage is not less than the maximum voltage, the controller 56 determines whether the voltage is greater than or equal to the maximum voltage (block 152). If the voltage is greater than or equal to the maximum voltage, the controller 56 modifies the voltage (e.g., or some other parameter) (block 154). For example, the controller 56 may apply a software adjustment to the voltage, such as by changing a negative proportional signal to a positive proportional signal, or by changing a positive proportional signal to a negative proportional signal. Furthermore, the controller 56 may categorize the signal as a negative proportional signal and may control the hydraulic device accordingly. As may be appreciated, the output provided to the hydraulic device may be based on the voltage and/or the modified (e.g., adjusted) voltage. Furthermore, while one method for categorizing the signals has been provided, other suitable methods for categorizing the signals may also be used.

Using the methods, devices, and systems described herein, the controller 56 may determine what type of hydraulic device is coupled to the controller 56, and may control the hydraulic device based on its type. Accordingly, one type of electrical cable may be used to couple the hydraulic device to the controller 56 regardless of the type of control system used by the hydraulic device. Furthermore, by determining the type of control system used by the hydraulic device, the service pack module 18 may be able to operate the hydraulic device using any available features of the hydraulic device. For example, a proportional signal of a hydraulic system using a negative proportional signal may be used to automatically adjust the output of the hydraulic pump 16 and/or to improve efficiency of the engine 14. As another example, the type of control system used by the hydraulic device will be detected, much like plug and play systems, so that an operator does not have to select the type of control system being used (e.g., such as via intricate and/or hard to access menus). Moreover, the hydraulic device may be able to use any available features of the service pack module 18. For example, the service pack module 18 may be able to efficiently manage outputs and/or engine speeds of the service pack module 18. In addition, an operator does not have to manually select what type of hydraulic device is connected to the controller 56 (e.g., an operator does not have to select the format of the communication between the hydraulic device and the controller 56). Rather, the controller 56 automatically determines the format for communicating with the hydraulic device based on the type of hydraulic device.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for modifying a signal from a hydraulic device electrically connected to a power supply, the method comprising:

detecting, using a controller, a voltage of the signal from the hydraulic device;

categorizing the signal as a type of signal of a plurality of types of signals based on the comparing the voltage for the signal to possible voltage values of hydraulic signals;

comparing the voltage to a first threshold voltage; and a) applying a first adjustment to the voltage when the voltage is greater than the first threshold voltage and less than a second threshold voltage; or b) applying a second adjustment to the voltage when the voltage is greater than or equal to the second threshold voltage.

2. The method of claim 1, wherein detecting the voltage of the signal from the hydraulic device comprises detecting the voltage of the signal from the hydraulic device before an engine of the power supply is turned on.

3. The method of claim 1, wherein the hydraulic device comprises a hydraulic crane.

4. The method of claim 1, wherein the first threshold voltage is less than the second threshold voltage.

5. The method of claim 1, wherein applying the first adjustment to the voltage comprises applying an offset to the voltage.

6. The method of claim 1, wherein applying the second adjustment to the voltage comprises changing between a negative proportional signal and a positive proportional signal.

7. The method of claim 1, comprising applying no adjustment to the voltage if the voltage is less than or equal to the first threshold voltage.

8. The method of claim 1, comprising controlling a hydraulic output based on the voltage, the first adjustment to the voltage, the second adjustment to the voltage, or some combination thereof.

9. The method of claim 8, wherein the hydraulic output comprises a quantity of hydraulic fluid.

10. The method of claim 1, comprising categorizing the signal as a normal signal, a step signal, a positive proportional signal, an offset step signal, a negative proportional signal, or some combination thereof.

11. A power supply comprising:

one or more tangible, machine-readable media having instructions encoded thereon for execution by a processor, the instructions configured to cause a controller of the power supply to at least:

determine a voltage of a signal from a hydraulic device;

categorize the signal as a type of signal of a plurality of types of signals based on the comparing the voltage for the signal to possible voltage values of hydraulic signals; and control an output based on the voltage and the type of the signal.

12. The power supply of claim 11, wherein the instructions further comprise instructions to:

compare the voltage to a first threshold voltage;

apply a first adjustment to the voltage when the voltage is greater than the first threshold voltage and less than a second threshold voltage; and apply a second adjustment to the voltage when the voltage is greater than or equal to the second threshold voltage.

13. The power supply of claim 12, wherein the instructions further comprise instructions to apply no adjustment to the voltage if the voltage is less than or equal to the first threshold voltage.

14. The power supply of claim 12, wherein the instructions to apply the first adjustment to the voltage comprise instructions to apply an offset to the voltage.

15. The power supply of claim 11, wherein the plurality of types of signals comprise one or more of a normal signal, a step signal, a positive proportional signal, an offset step signal, or a negative proportional signal.

* * * * *